US005749134A

United States Patent [19]

Zemitis

[11] Patent Number: 5,749,134

[45] Date of Patent: May 12, 1998

[54] SLIDE FASTENER REPAIR SYSTEM

[76] Inventor: Martin S. Zemitis, 436 Citadel Dr., Davis, Calif. 95616

[21] Appl. No.: 683,084

[22] Filed: Jul. 18, 1996

[51] Int. Cl.[6] ..... B23P 6/00

[52] U.S. Cl. ..... 29/402.08; 24/436; 24/381; 29/401.1; 29/402.12; 29/767; 29/408

[58] Field of Search ..... 29/401.1, 402.03, 29/402.08, 402.11, 402.12, 767, 766, 408, 525.02; 24/381, 387, 388, 390, 433, 434, 435, 436

[56] References Cited

U.S. PATENT DOCUMENTS

| | | | |
|---|---|---|---|
| 2,460,124 | 1/1949 | Carlile . | |
| 2,483,703 | 10/1949 | Legat . | |
| 3,353,256 | 11/1967 | Frohlich et al. . | |
| 3,698,064 | 10/1972 | Uhrig . | |
| 4,224,730 | 9/1980 | Kanzaka . | |
| 4,246,681 | 1/1981 | Yamada . | |
| 4,368,570 | 1/1983 | Morita . | |
| 5,231,736 | 8/1993 | Hohenocker et al. | 24/387 X |

FOREIGN PATENT DOCUMENTS

| | | | |
|---|---|---|---|
| 610039 | 12/1960 | Canada | 24/381 |
| 1037791 | 8/1966 | United Kingdom | 24/387 |

*Primary Examiner*—James R. Brittain
*Attorney, Agent, or Firm*—Thomas R. Lampe

[57] ABSTRACT

A slide fastener repair system including a method in which an opening is formed in a slide fastener to create a gap in a row of fastener elements, removing the slide fastener slider through the opening, positioning a replacement slider on the teeth of the slide fastener at the opening and attaching a slider stop at the opening.

7 Claims, 5 Drawing Sheets

SLIDE FASTENER REPAIR SYSTEM

TECHNICAL FIELD

This invention relates to slide fasteners, and more particularly to a method of repairing such fasteners. The invention further encompasses apparatus for effecting repair of slide fasteners.

BACKGROUND ART

Slide fasteners have been in widespread use for many years for securing objects together. Such fasteners typically employ two rows of fastener elements such as teeth or coils which are selectively connected together or removed from one another by a slider.

Devices of this nature have found widespread acceptance not only in the field of clothing but in many other areas as well. For example, slide fasteners are employed in tents, backpacks and sleeping bags. Many such uses cause considerable wear and tear on the slide employed in the slide fastener. Typically, slides are the first component of a slide fastener to wear and thus lose effectiveness.

Slider replacement is often a relatively difficult, time consuming task and as a consequence, the entire slide fastener structure is often replaced even though the slider is the only defective or deficient component.

A search of the prior art located the following United States patents which relate to slide fasteners: U.S. Pat. No. 3,698,064, issued Oct. 17, 1972, U.S. Pat. No. 3,353,256, issued Nov. 21, 1967, U.S. Pat. No. 2,460,124, issued Jan. 25, 1949, U.S. Pat. No. 4,368,570, issued Jan. 18, 1983, U.S. Pat. No. 4,246,681, issued Jan. 27, 1981, U.S. Pat. No. 4,224,730, issued Sep. 30, 1980, and U.S. Pat. No. 2,483,703, issued Oct. 4, 1949.

None of the located patents disclose or suggest the slide fastener repair system disclosed and claimed herein. U.S. Pat. No. 3,353,256 and other patents indicated above are concerned with the manufacture of slide fasteners. U.S. Pat. No. 3,353,256 discloses a manufacturing method wherein slide fasteners are produced from a continuous strip of interlinked fastener bands and wherein T-shaped windows are formed at spaced locations along the strip. Respective sliders are mounted thereon by pressing them against the strip so as to form inclined longitudinal edges for the respective windows. The strips are continuously displaced during the manufacturing process while holding the sliders stationary to draw the slider onto the respective strip. The strip is severed after mounting of the sliders to produce individual slide fasteners.

The method of U.S. Pat. No. 3,353,256 is not directed to the repair of slide fasteners and is inappropriate therefor. A somewhat similar arrangement wherein gaps or openings are formed in the elongated slide fastener strip during manufacture of individual slide fasteners is shown in U.S. Pat. No. 3,698,064, the method of this latter patent also being inappropriate for repair of slide fasteners.

DISCLOSURE OF INVENTION

The present invention encompasses a method of repairing a slide fastener, and more particularly to a method which allows for the ready replacement of the slider component of the slide fastener. The slide fastener to be repaired includes a pair of elongated slide fastener strips, each slide fastener strip having a row of fastener elements having a pair of spaced row ends connected thereto. A slider is slidably positionable on the rows of fastener elements for selectively securing the rows of fastener elements.

The method includes the step of forming an opening in the slide fastener at a location adjacent to the slider to create a gap in at least one of the rows of fastener elements.

The slider is slid along at least one of the rows of fastener elements to the opening.

The slider is separated from the remainder of the slider fastener by disengaging the slider from fastener elements adjoining the gap and passing at least a portion of the slider through the opening.

A replacement slider is positioned at the opening and at least a portion of the replacement slider is passed through the opening. The replacement slider is engaged with fastener elements adjoining the gap.

The replacement slider is slid along at least one of the rows of fastener elements in a direction away from the opening.

While the replacement slider is spaced from the opening and slidably engaged with at least one row of fastener elements, a slider stop is attached to the slide fastener at a location thereon which will result in engagement between the slider stop and the replacement slider when the replacement slider is slid along at least one row of fastener elements toward the opening. The slider stop upon engagement therewith by the replacement slider prevents movement of the replacement slider toward the opening and further prevents disengagement of the replacement slider from the associated at least one row of fastener elements.

The present invention also encompasses a slider stop for use with a slide fastener and utilized during the above-described repair method.

Other features, advantages, and objects of the present invention will become apparent with reference to the following description and accompanying drawings.

MODES FOR CARRYING OUT THE INVENTION

Referring now to FIGS. 1–3A, a conventional slide fastener 10 is illustrated. Slide fastener 10 includes a pair of elongated slide fastener strips 12, 14, each slide fastener strip having a row of fastener elements in the form of slide fastener coils 16 connected thereto. The rows of fastener elements have spaced ends.

A slider 18 is slidably positionable on the rows of fastener elements to selectively secure together the rows thereof.

Over the course of time, the slider 18 may become worn and operatively deficient. The method which will now be described enables an individual to quickly and efficiently replace the slider.

Figure 1:
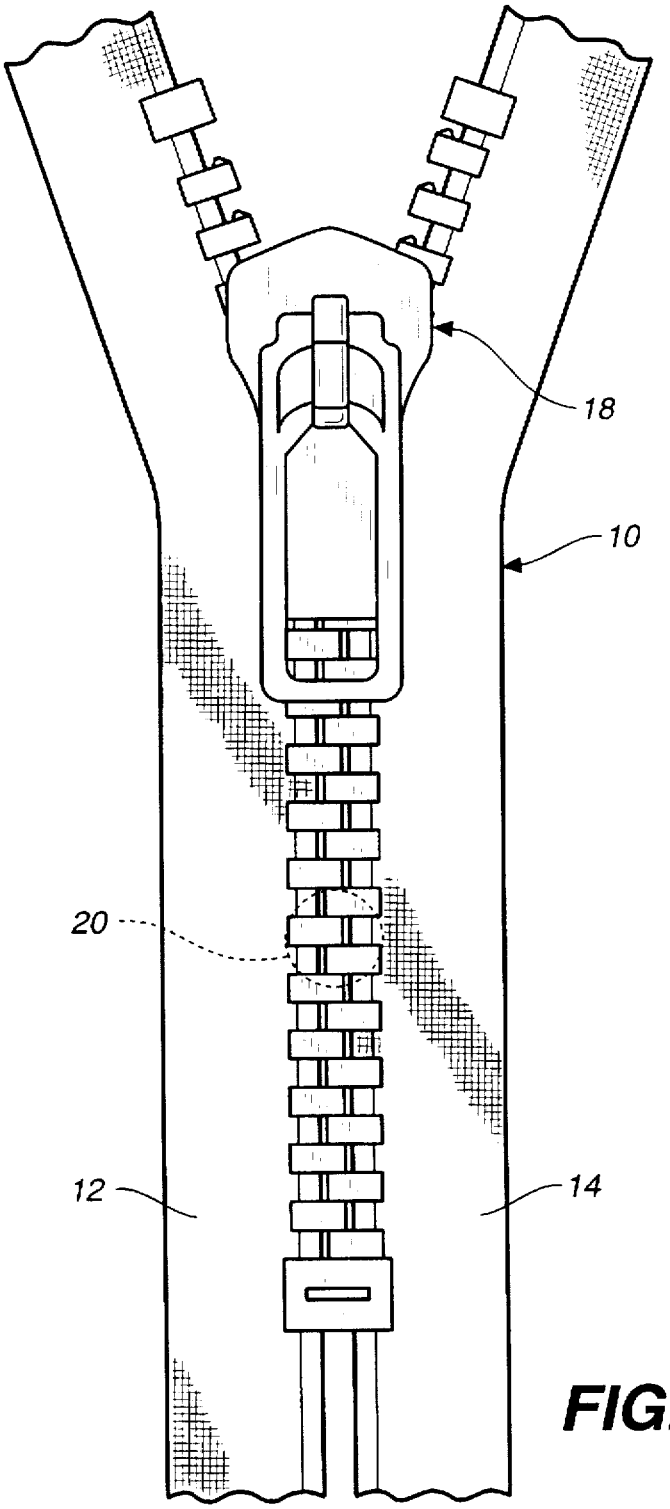
FIG. 1 is a top plan view of one form of a portion of a conventional slide fastener for repair in accordance with the teachings of the present invention.
Figure 2:
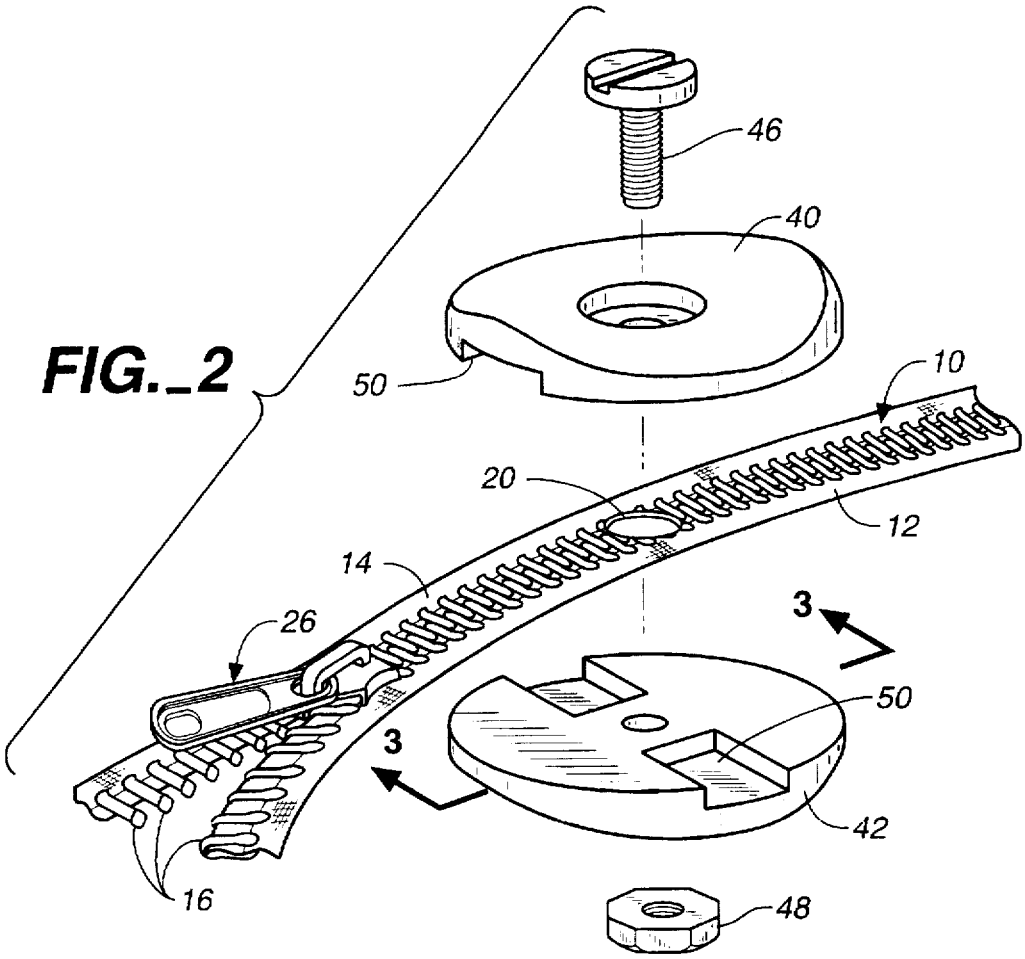
FIG. 2 is a perspective view of the slide fastener illustrating an opening formed therein and a slider stop prior to engagement with the slide fastener.

First, as shown in FIGS. 1 and 2, an opening 20 is cut or punched in the slide fastener at a location adjacent to the slider. In the embodiment of the invention under discussion, the opening 20 is formed in both fastener element rows and both elongated slide fastener strips. A gap is thus created in each of the rows of the fastener elements at the location of the opening or hole.

Next the slider 18 is slid along the rows of fastener elements to opening 20. Once the slider reaches the opening and the gaps in the rows of fastener elements it is an easy matter to separate the slider from the remainder of the slider fastener by disengaging the slider from the fastener elements adjoining the gaps and pulling the slider through and out of the opening.

Figure 2A:
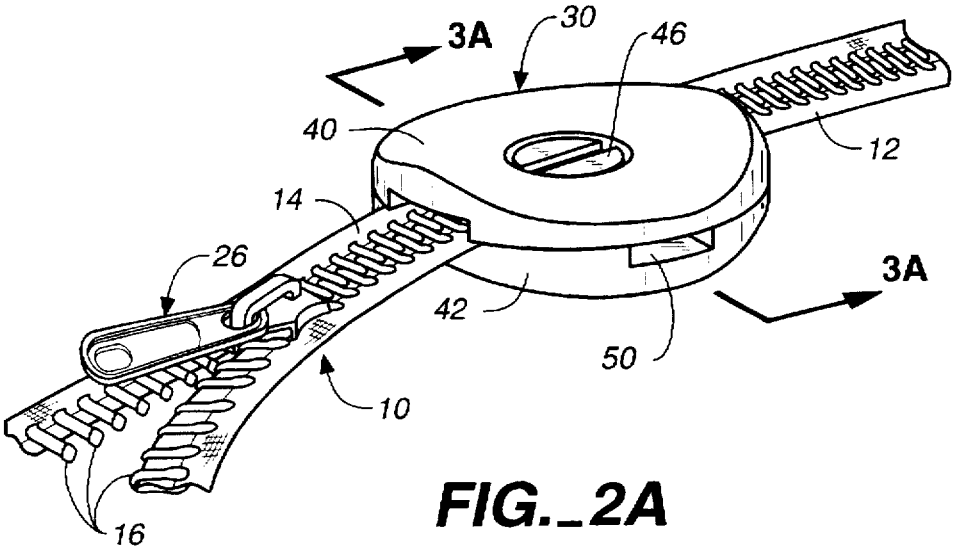
FIG. 2A is a view similar to FIG. 2 but illustrating the slider stop clamped in position.
Figure 3:
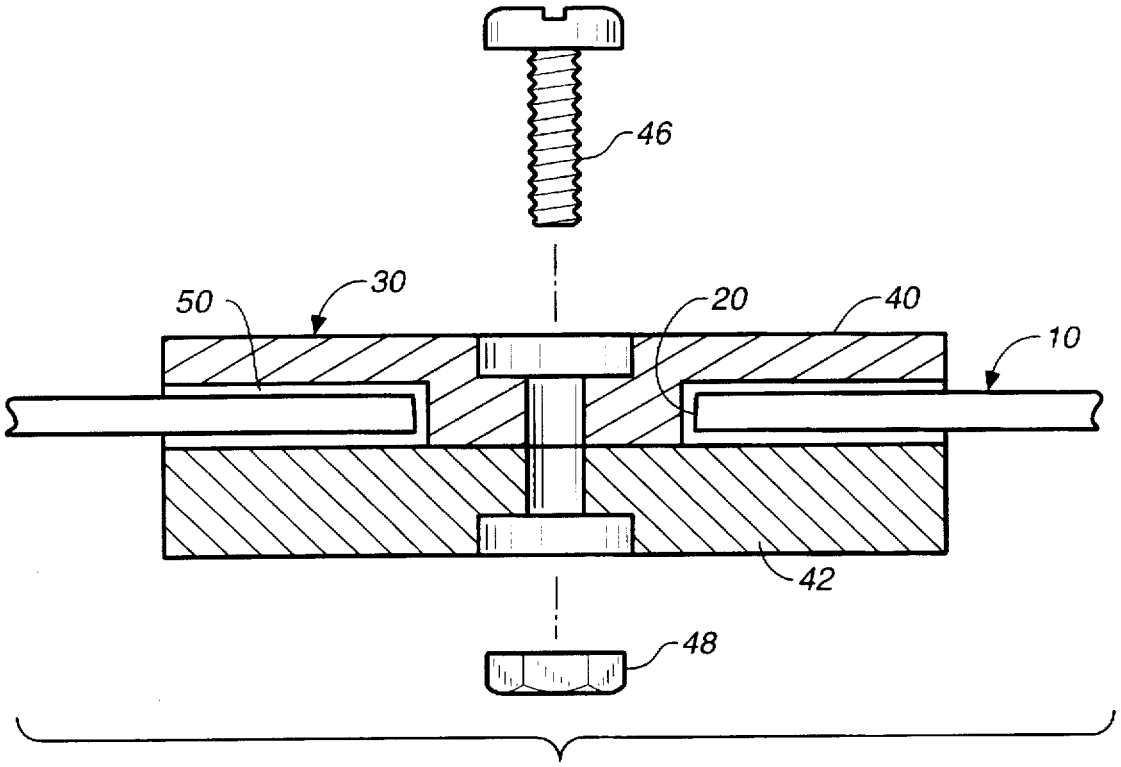
FIGS. 3 and 3A are enlarged cross-sectional views of the assembled slider stop as taken along line 3—3 of FIG. 2 and line 3A—3A of FIG. 2A, respectively.
Figure 3A:
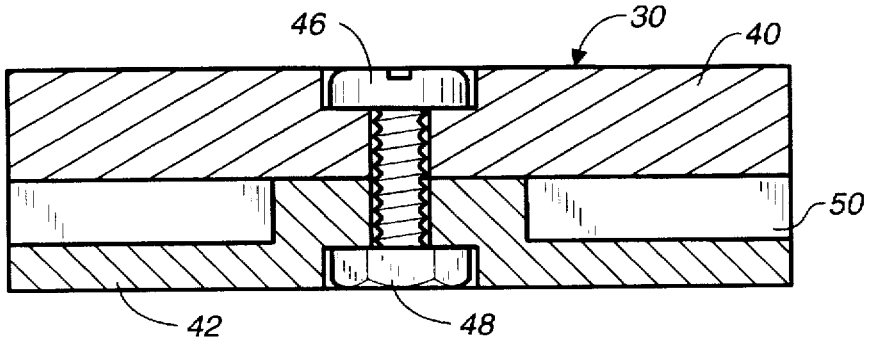

Referring now to FIGS. 2 and 2A, a replacement slider 26 is positioned at the opening and a portion thereof passed through the opening.

The replacement slider 26 is engaged with the fastener elements adjoining the gaps in the rows of fastener elements and the replacement slider is slid along the rows of fastener elements in a direction away from the opening.

While the replacement slider 26 is spaced from opening 20 and slidably engaged with the rows of fastener elements, A slider stop 30 is attached to the slide fastener at a location thereon which will result in engagement between the slider stop and the replacement slider when the replacement slider is slid along the rows of fastener elements toward the opening. The slider stop 30 upon engagement therewith by the replacement slider prevents movement of the replacement slider toward the opening and further prevents disengagement of the replacement slider from the associated rows of fastener elements. That is, the replacement slider cannot reach opening 20 and pass therethrough.

The slider stop 30 is in the nature of a clamp and includes two slider stop clamp elements 40, 42 secured together by mechanical connector means in the form of threaded bolt or pin 46 extending through the clamp elements and therebetween. Member 46 is threadably engaged with a nut 48 so that the clamp elements may be moved toward or away from each other depending upon whether the threaded member 46 is rotated clockwise or counterclockwise relative to the nut.

The clamp elements 40, 42 are positioned on opposite sides of the elongated slide fastener strips 12, 14 and cover the opening 20 on both sides of the slide fastener. Each of the clamp elements has a surface, hereinafter referred to as a clamping surface, which engages its respective side of the elongated slide fastener strips. The clamp elements 40, 42 are sized to bridge the gaps in the rows of fastener elements at the opening. Removal of the slider stop will enable other subsequent changings of the slider, as required.

In the arrangement illustrated, a segmented notch 50 is defined by each of the clamp elements, the notch segments projecting inwardly from the respective clamping surfaces. The notch segments of clamp element 40 are coaxial with and receive the rows of fastener elements. The notch segments of clamp element 42 are orthogonally disposed relative to the rows of fastener elements so tight clamping engagement exists between the planar clamping surfaces of the clamp elements and the slide fastener strips.

Figure 4:
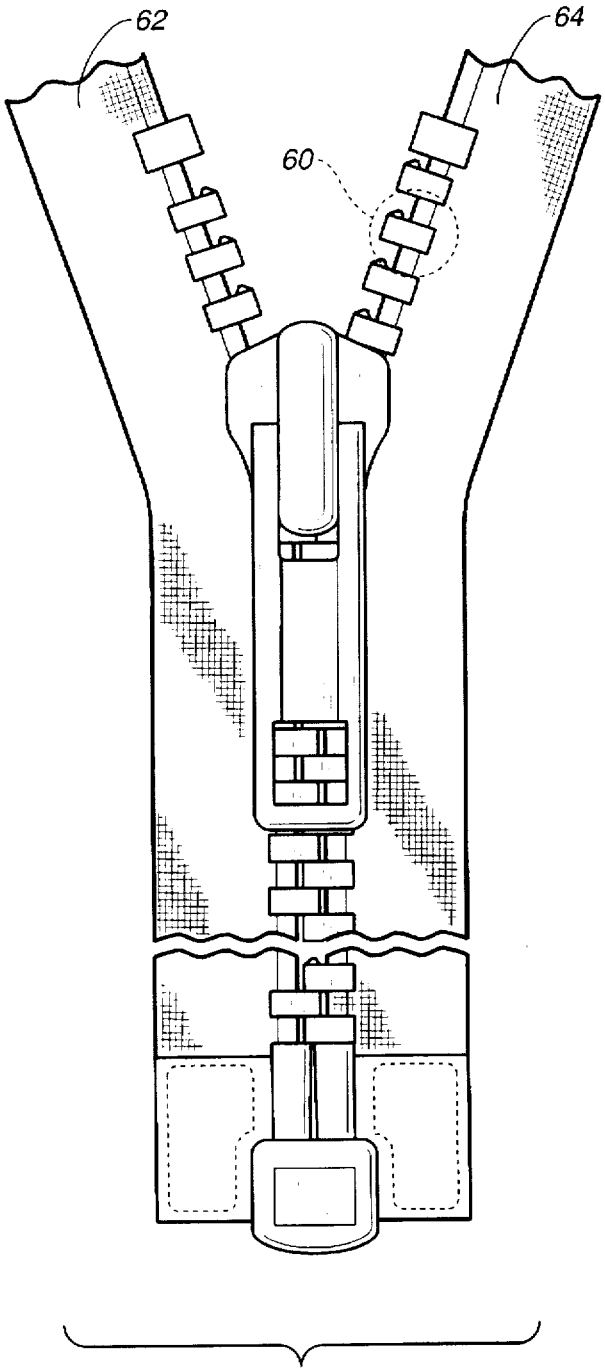
FIG. 4 is a view similar to FIG. 1 but illustrating an alternative form of slide fastener.
Figure 5:
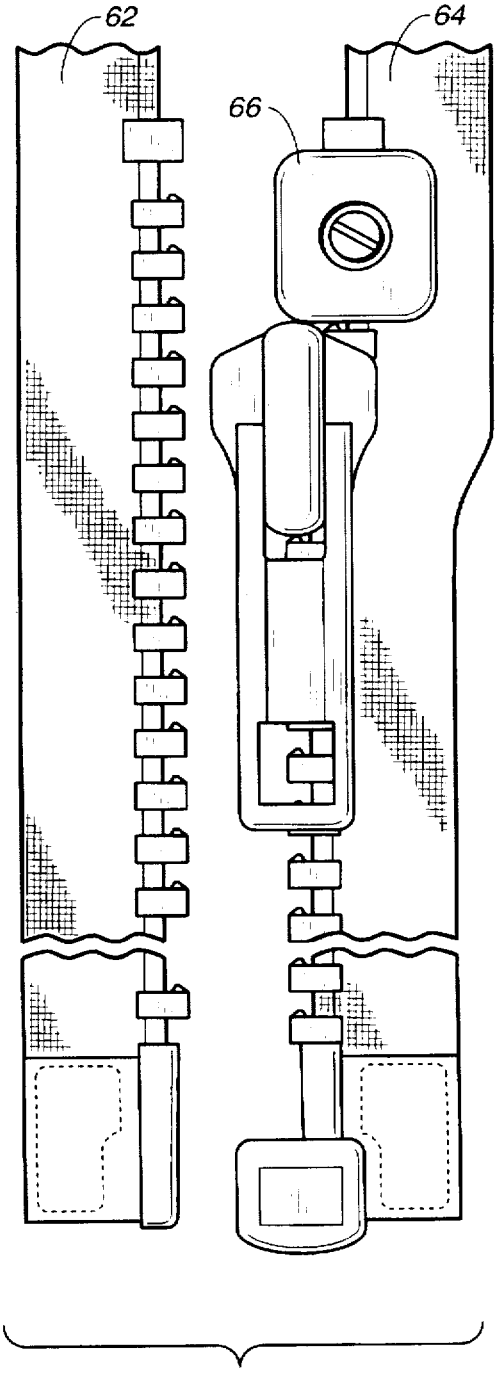
FIG. 5 is a top plan view of the slide fastener of FIG. 4, the fastener strips thereof being separated and a slider stop clamped to one of the fastener strips.

FIGS. 4 and 5 illustrate another form of the invention wherein an opening 60 is formed in one of the slide fastener strips 62, 64 (fastener strip 64), the opening 60 forming a gap in only one row of fastener elements. The associated slider stop 66 (FIG. 5) is mounted on only one of the slide fastener strips or tapes, i.e. fastener strip 64. The slider stop 66 has a somewhat different shape than slider stop 30 and is smaller.

The slide fastener shown in FIGS. 4 and 5 is of the type commonly employed in sleeping bags and clothing whereas that illustrated with respect to the first embodiment described above is commonly employed in backpacks and tents, for example.

Figure 6:
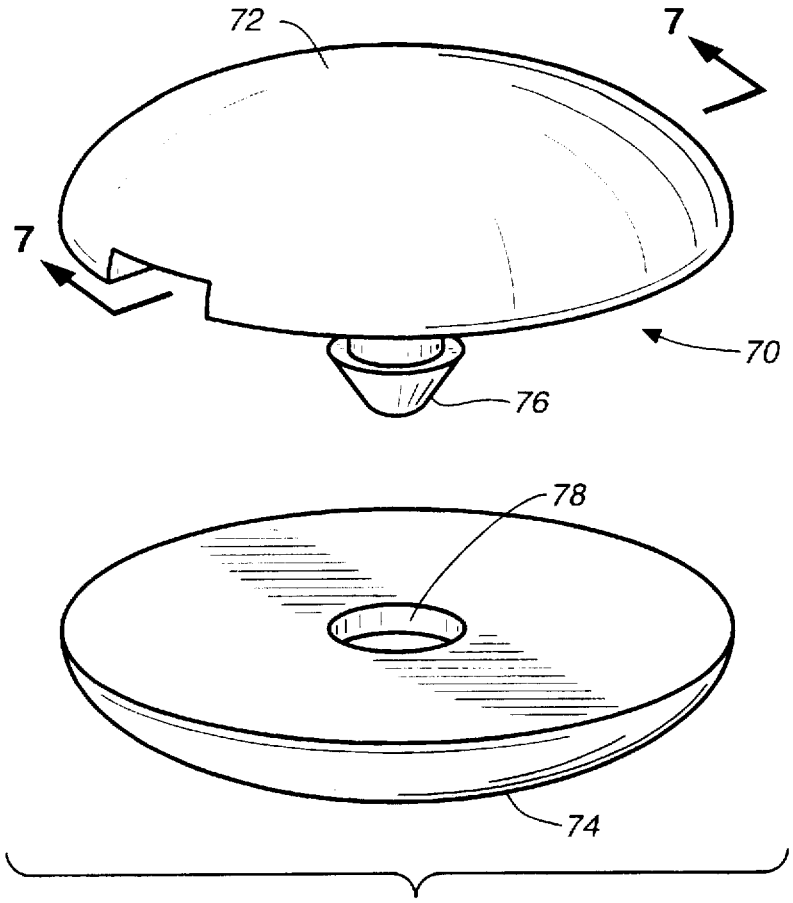
FIG. 6 is a perspective view of an alternate form of slider stop constructed in accordance with the teachings of the invention.
Figure 7:
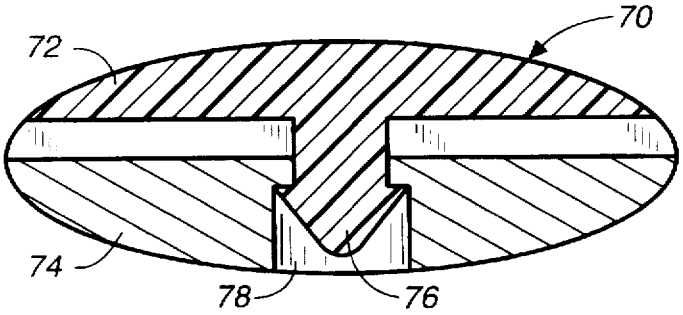
FIG. 7 is an enlarged side view of the slider stop of FIG. 6.

FIGS. 6 and 7 illustrate another form of slider stop 70 wherein the clamp elements 72, 74 have planar clamping surfaces. A detent having an enlarged tapered head 76 projects from the clamping surface of clamp element 72 and is positionable in a recess 78 projecting inwardly from the clamping surface of clamp element 74 to secure the clamp elements together.

The clamp elements of all the embodiments may be formed of any suitable material such as plastic or metal.

I claim:

1. A method of repairing a slide fastener, said slide fastener including a pair of elongated slide fastener strips each slide fastener strip having a row of fastener elements having a pair of spaced row ends connected thereto and a slider slidably positionable on said rows of fastener elements for selectively securing said rows of fastener elements, said method comprising the steps of:

forming an opening in said slide fastener at a location adjacent to said slider to create a gap in at least one of said rows of fastener elements;

sliding said slider along at least one of said rows of fastener elements to said opening;

separating said slider from the remainder of said slider fastener by disengaging said slider from fastener elements adjoining said gap and passing at least a portion of said slider through said opening;

positioning a replacement slider at said opening;

passing at least a portion of said replacement slider through said opening;

engaging said replacement slider with fastener elements adjoining said gap;

sliding said replacement slider along at least one of said rows of fastener elements in a direction away from said opening; and while said replacement slider is spaced from said opening and slidably engaged with at least one row of fastener elements, attaching a slider stop to said slide fastener at a location thereon which will result in engagement between said slider stop and said replacement slider when said replacement slider is slid along at least one row of fastener elements toward said opening, said slider stop upon engagement therewith by said replacement slider preventing movement of said replacement slider toward said opening and further preventing disengagement of the replacement slider from the associated at least one row of fastener elements.

2. The method according to claim 1 wherein the step of forming said opening comprises forming an opening in both rows of fastener elements to create gaps in both of said rows of fastener elements.

3. The method according to claim 1 wherein the step of forming an opening includes cutting at least one of said elongated slide fastener strips.

4. The method according to claim 3 wherein the step of forming said opening includes cutting both of said elongated slide fastener strips.

5. The method according to claim 1 wherein said step of attaching a slider stop to said slide fastener comprises clamping said slider stop to said slide fastener at said location.

6. The method according to claim 5 wherein said slider stop includes two slider stop clamp elements, said step of attaching a slider stop to said slide fastener comprising placing one of said clamp elements on one side of at least one of said elongated slide fastener strips at said opening, placing the other of said clamp elements on the opposed side of said at least one elongated slide fastener strip, interconnecting said clamp elements through said opening, and moving said clamp elements toward one another and into clamping engagement with said at least one elongated slide fastener strip.

7. The method according to claim 6 wherein at least one of said clamp elements is positioned to bridge said gap.

* * * * *